United States Patent [19]

Vial et al.

[11] 4,131,154

[45] Dec. 26, 1978

[54] ROLLER APRON FOR A CONTINUOUS CASTING INSTALLATION FOR STEEL

[75] Inventors: Raymond Vial, Lorette, France; Herbert Fastert, Wyckoff, N.J.; Heinrich Marti, Forch, Switzerland

[73] Assignee: Concast AG, Zürich, Switzerland

[21] Appl. No.: 815,664

[22] Filed: Jul. 14, 1977

[30] Foreign Application Priority Data

Jul. 16, 1976 [FR] France ..... 76 21829
May 13, 1977 [CH] Switzerland ..... 5992/77

[51] Int. Cl.[2] ..... B22D 11/12

[52] U.S. Cl. ..... 164/448; 164/442; 164/82

[58] Field of Search ..... 164/448, 442, 82

[56] References Cited

U.S. PATENT DOCUMENTS 3,538,980 11/1970 Gallucci ..... 164/442 X
3,794,107 2/1974 Bollig et al. ..... 164/442 X
3,891,025 6/1975 Bollig et al. ..... 164/448 X
4,018,261 4/1977 Scheineches et al. ..... 164/448

*Primary Examiner*—Robert L. Spicer, Jr.
*Attorney, Agent, or Firm*—Werner W. Kleeman

[57] ABSTRACT

A roller apron or strand guide assembly for a continuous casting installation for casting metals, especially steel, in particular equipped with driving- and/or straightening rollers, wherein in the direction of travel of the strand immediately following pairs of rollers are mutually independently displaceable along comb-like arranged guides dispositioned to both sides of the machine frame transversely with respect to the direction of travel of the cast strand. The bearings of both rollers of a roller pair are each mounted upon a transverse support, which transverse support cooperates with the comb-like arranged guides and can be moved by pressure cylinder means. Further, at least the transverse support can be adjusted by non-driven rollers against stops provided at the machine frame.

9 Claims, 5 Drawing Figures

ROLLER APRON FOR A CONTINUOUS CASTING INSTALLATION FOR STEEL

BACKGROUND OF THE INVENTION

The present invention relates to a new and improved construction of a roller apron or strand guide assembly — sometimes also referred to in the art as a roller apron framework — for a continuous casting installation, especially for casting steel, which particularly is of the type equipped with driving and/or straightening rollers, and in the direction of travel of the strand directly following roller pairs can be mutually displaced independently along comb-like arranged guides disposed to both sides of the machine frame transversely with respect to the direction of strand travel.

During the continuous casting of slabs and large bloom installations the strand is only partially solidified in the roller apron of the secondary cooling zone and oftentimes also upon entry into the driving- and/or straightening roller framework of curved- or arc-type casting installations. Such roller aprons are assigned the function of guiding the strand, supporting the ferrostatic pressure of the liquid core acting upon the strand shell or skin in order to prevent bowing-out, and introducing the dummy bar which is usually thinner than the strand thickness to be cast into the mold. Upon increase of the casting speed, in the case of arc-type continuous casting installations, the liquid core oftentimes extends for a considerable extent into the horizontally arranged portion of the roller apron and the driving machine or assembly, thus requiring long supporting roller aprons or supporting frameworks.

From U.S. Pat. No. 3,722,576 there is known to the art a withdrawal and straightening machine, the rollers of which are mounted independently of one another in the machine frame. Driven upper rollers of roller pairs are arranged upon transverse supports. The end surfaces of the roller bearings are provided with guides which are displaceable transversely with respect to the direction of travel of the strand in grooves of the machine frame. The non-driven lower rollers, situated opposite the driven rollers, are fixedly mounted in the machine frame. The roller pairs neighboring the roller pairs having driven rollers are likewise fixedly mounted at the machine frame. Such fixedly mounted rollers cannot positionally shift or deviate in the presence of overloads, such as for instance during straightening a strand which is too cold or during throughpassage of a bowed-out solidified strand. The consequence of such is roller rupture, bent rollers and damage to the bearings of the rollers.

U.S. Pat. No. 3,963,069 discloses a further prior art roller apron or roller apron framework for support- and drive rollers wherein two rollers which follow one another along a roller apron path are arranged upon a common, pivotable transverse support. At both sides of the rollers there are mounted at the roller bearings sliding blocks which are movable in guides provided transverse to the guided strand surface. The hingedly connected sliding block enables the transverse support to carry out a pivotal movement. For each of both rollers there is mounted at the transverse support an impact or stop surface which cooperates with support surfaces provided at the machine frame. In the presence of overloading of a roller the transverse support can tilt about one of the stop surfaces. The arrangement of, in each instance, two rollers upon a transverse support requires for exchange or replacement of the rollers relatively expensive and heavy roller changing units. Furthermore, the structure of the machine frame hinders exchange of the rollers of the lower roller track or path together with the associated transverse support. During disassembly of such lower rollers their bearings within the machine must be detached from the transverse support and upon assembly again connected, requiring long change times and reducing the availability of the machine.

British Pat. No. 1,241,918 discloses a roller apron for continuous casting installations having a partially curved strand guide arrangement or roller apron wherein in order to obtain short change times of the rollers, directly following or successive roller pairs are mutually displaceable independently of one another along guides arranged transverse to the direction of travel of the strand. These guides arranged at both sides of the machine frame between the rollers are of comb-like construction. The bearing of a roller pair slides along these guides, during the roller-exchange operation. During the casting operation the rollers which are hingedly connected at a transverse support are safeguarded against overload at the detachment side. For this purpose the transverse support is provided with two pressure cylinder means. The roller bearings or supports thus slide along the guide. At the fixed side, the roller bearings are rigidly attached to the machine frame. Between both rollers of a roller pair there are provided exchangeable intermediate elements which are accommodated to the strand format or shape. The rollers at the detachable side are capable of being brought into contact with such intermediate elements by the pressure cylinder means. With this roller apron the rollers are not protected against overload at the fixed side. Moreover, due to the sliding mounting of the roller bearings at the comb-like guide there is present a relatively large roller spacing or pitch and/or a weak dimensioning of these comb-like guides, which can lead to deformation of the guide and to an inexact roller apron geometry. Large roller spacing can lead to bowing-out of the strand and the attendant metallurgical drawbacks. By virtue of the pressure cylinder means arranged in the horizontal part of the guide above the roller apron, such roller apron construction, when using oil as the hydraulic fluid medium, also is prone to a latent danger of fires breaking out. Furthermore, at the fixed side, with this arrangement, it is not possible to employ any rollers having a number of roller bearings. When disassembling the rollers it is always necessary to also disassemble the pressure cylinder means.

SUMMARY OF THE INVENTION

Hence it is a primary object of the present invention to provide a new and improved construction of roller apron for a continuous casting installation for casting strands or the like, which is not associated with the aforementioned drawbacks and limitations of the prior art constructions.

Another and more specific object of the present invention aims at the provision of a new and improved construction of roller apron, especially for driving- and/or straightening rollers of a continuous casting installation, wherein each roller is itself protected against overload, there is attained small roller spacing of the successive rollers following one another in the direction of travel of the strand and at the same time it is possible to dimension, so as to be bending-resistant, guides arranged transverse to the direction of strand travel.

Yet a further significant object of the present invention is to provide a new and improved roller apron which enables rapid exchange of the rollers and permits a rational adjustment of the shape or cross-section of the strand being cast and a free design of the roller supports for slab casting installations which cast strands of, for instance, a width exceeding 2.20 meters.

Now in order to implement these and still further objects of the invention, which will become more readily apparent as the description proceeds, the roller apron of the present development is manifested by the features that the bearings of both rollers of a roller pair are each independently mounted at a transverse support, this transverse support cooperates with the comb-like arranged guides and is movable by pressure cylinder means. Further, at least the transverse support for non-driven rollers can be brought into contact with or applied against stops or impact members provided at the machine frame.

The inventive roller apron is surprisingly manifested by a number of advantages, which improve the continuous casting of strands, both with respect to metallurgical conditions as well as also for machine design reasons. The rigid arrangement of each roller upon an elastically applied transverse support and the comb-like guide supports cooperating with each pair of transverse supports forms a faultless and simple overload safety device, whereby the guiding of the transverse supports at the guides not only allows for small roller spacing but additionally the construction of bending-resistant supports for the comb-like guides. The attainment of small roller spacing reduces the danger of bowing-out of the cast strand and thus has a positive effect upon the metallurgical quality of the cast strand. The application or bringing into contact of the transverse supports at the stops or impact members provided at the machine frame furthermore facilitates, on the one hand, the exact adjustment and control of the rollers of both strand paths or tracks to a reference position, without, on the other hand, reducing the advantages of the comb-like guides with respect to rapid roller exchange. At the same time the stops provided at the machine frame also permit a rapid changeover of the strand shape or cross-section. Apart from the foregoing advantages the transverse supports at both oppositely situated strand paths or tracks also renders possible, however, a free configuration of multiple supported rollers for slab casting installations for casting strands having a width exceeding 2.20 meters.

The pressure cylinder means or piston-cylinder units could be arranged, for instance, for the upper transverse support externally of the comb-like guide and for the lower transverse support within such comb-like guides which are dispositioned at both sides of the machine frame. In order to reduce the danger of fire, brought about by the pressure cylinder means arranged within the comb-like guides, when using oil as the hydraulic fluid medium, and in order at the same time to reduce the number of pressure cylinder means, it is however of advantage if both of the transverse supports of the roller pair are connected at both sides of the machine frame externally of the guides by pressure cylinder means. The accessibility to the spacer elements can be improved and additionally there can be reduced the danger of fire, if the pressure cylinder means are arranged at the outside of the transverse support of a lower roller, said side being situated opposite the attachment side of the bearings. With this arrangement the pressure cylinder means is situated externally of the radiation zone of the strand. During disassembly of the rollers it is moreover possible to permit the pressure cylinder means to remain in the machine frame.

In order to reduce the required number of cylinders per roller pair, a further aspect of the invention contemplates connecting the transverse supports of two rollers which follow one another in the direction of strand travel, externally of the guides by means of a balance-beam like bracket interconnecting both transverse supports with a common pressure cylinder means for both of these rollers. Due to the reduction of the number of pressure cylinder means it is possible to provide economies in the fabrication of the continuous casting installation.

In order to introduce a dummy bar which is thinner in relation to the cast strand, at least a part of the driving or drive rollers must be able to be moved over the strand path-reference dimension for the cast strand in the direction of the strand. Consequently, there is ensured for a faultless frictional contact between the dummy bar and the driving rollers. In order that the driving rollers are not able to exert any damaging forces upon such cast strand also during the transport or feed of the cast strand, it is additionally of advantage if there is arranged between the stops or impact members and the transverse support carrying a driven roller an additional pressure cylinder means which is equipped with a displacement limiting means for its piston. By using such additional pressure cylinder means there is furthermore achieved the beneficial result that there is no rolling contact of the cast strand with changing casting parameters during a pour which is in process, such as can occur for instance with different strand temperatures or with changing position of the lowest point of the liquid pool. Hence, there can be produced strands having improved structure and with smaller thickness tolerances.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
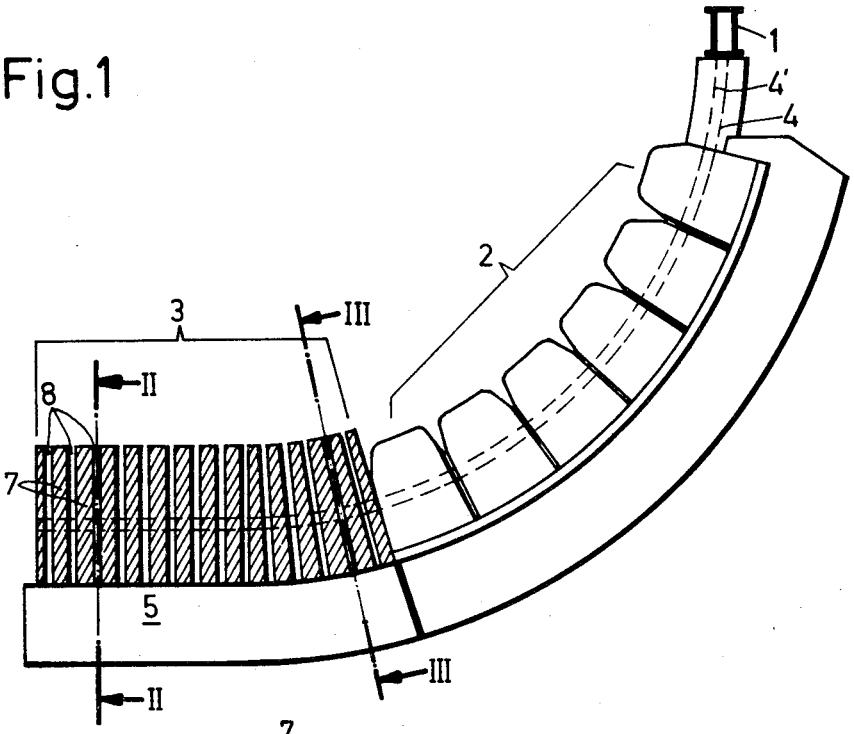
FIG. 1 is a schematic side view of a curved- or arc-type continuous casting installation for strands.

Describing now the drawings, it is to be understood that only enough of the continuous casting installation has been shown therein in order to enable those skilled in the art to readily understand the underlying principles and concepts of this invention. Turning attention to FIG. 1, a mold 1 of an arc-type or curve-shaped secondary cooling zone 2 is illustrated, and following thereat a withdrawal and straightening machine 3. Reference characters 4 and 4' represent the strand tracks or paths of the fixed side and the release or detachment side, respectively, of the roller apron. A machine frame 5 of the withdrawal and straightening machine 3 comprises a base frame which is equipped with comb-like guides 7. At both sides of the machine frame 5 the guides 7 extend transversely with respect to the direction of travel of the cast strand 10. In the intermediate spaces 8 there are displaceably arranged, in the direction of travel of the strand, non-illustrated rollers which directly follow one another. In this withdrawal and straightening machine 3 successive roller pairs, which also may be referred to as modules, can contain driving rollers, straightening rollers or non-driven rollers. The secondary cooling zone 2 in the embodiment under discussion, is formed of exchangeable segments. When necessary, it would however also be possible to construct the roller apron of the secondary cooling zone 2 in the same manner as the withdrawal and straightening machine 3.

Figure 2:
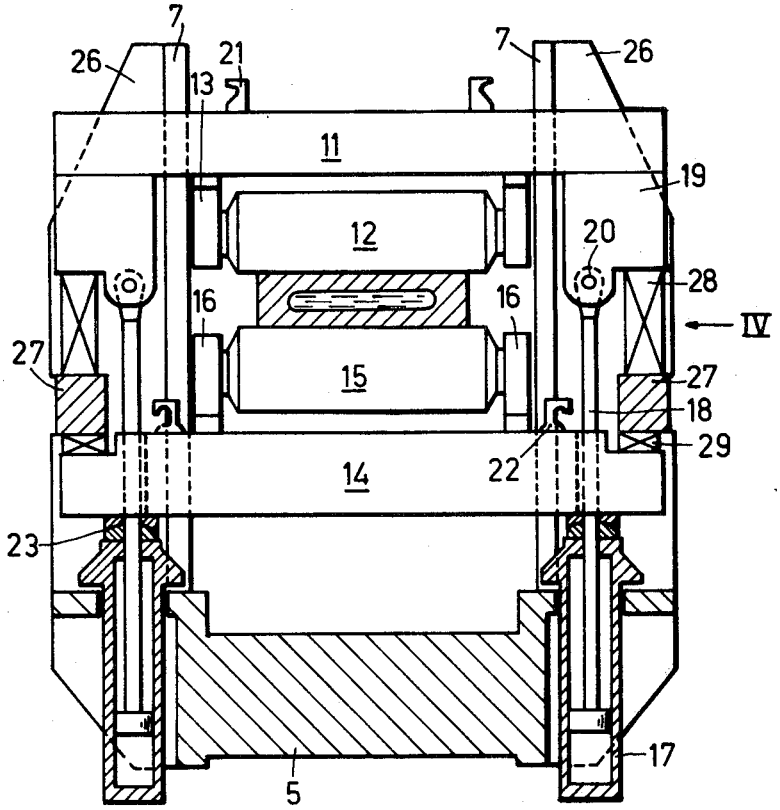
FIG. 2 is a cross-sectional view, taken substantially along the line II—II of FIG. 1, through the withdrawal and straightening machine thereof.
Figure 4:
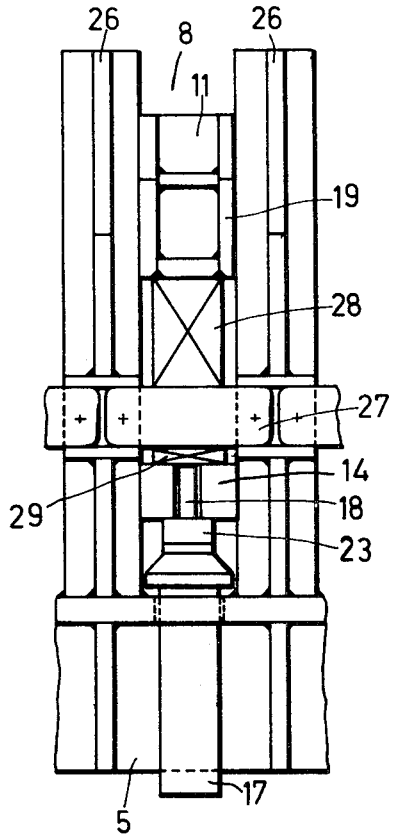
FIG. 4 is a side view looking in the direction of the arrow IV of FIG. 2.

In FIGS. 2 and 4 there are arranged at a non-driven module bearings or supports 13 and 16 for the rollers 12 and 15 of a roller pair, each such bearing being mounted itself upon a respective transverse support 11 and 14, as shown. These transverse supports 11 and 14 cooperate with the guides 7 arranged in comb-like fashion at both sides of the machine frame 5. The upper transverse support 11 is hingedly connected by means of welded brackets or straps 19 through the agency of bolts 20 or the like at the piston rods 18 of the pressure cylinder means or piston-and-cylinder and-cylinder units 17. In this embodiment both of the transverse supports 11 and 14 of the rollers 12 and 15, respectively, are connected at both sides of the machine frame 5 externally of the guides 7 by the piston rods 18 and the pressure cylinder means 17. At the outside of the transverse support 14 of the lower roller 15, situated opposite the attachment side for the bearings 16, there are mounted the pressure cylinder means 17. Both transverse supports 11, 14 are applied, with the constructive solution under consideration, with the same force through the agency of intermediate elements or members 28, 29 against the stop or impact members 27 attached to the machine frame 5. The intermediate elements 29 for the lower transverse support 14 serve for adjustment of the lower roller 15 at the strand track or path 4 (FIG. 1) of the fixed side and the exchangeable intermediate element 28 for the upper transverse support 11 serves for accommodation to different thicknesses during the casting of strands. The contact force of the pressure cylinder means 17 is designed such that the strand 10 cannot bow-out. When desired, during normal operation it is possible to provide a low rolling off action per roller pair of the still partially liquid strand 10 by applying a low pressure increase and by appropriately dimensioning the intermediate elements 28. When transporting cooled strands through the withdrawal and straightening machine 3 the rollers arranged at the movable transverse supports can deviate or move upwardly and downwardly. By providing spherically constructed intermediate elements 23 it is possible, in the presence of overload, to raise the lower transverse support 14 also at one side from the stops or impact members 27. For this purpose, the pressure cylinder means 17 in the operating position are in a raised, contactless position in relation to the machine frame 5, so that they can position themselves together with the lower transverse support 14 through a certain order of magnitude or degree in an inclined position. When relieving the load of the pressure cylinder means 17 such again, along with the transverse support 14, bear against the machine frame 5.

During the disassembly of the rollers the following work is to be accomplished in sequence. The bolts 20 at the upper transverse support 11 are removed, and by means of cables or the like attached at the hooks 21 this transverse support 11 can be lifted-out. If, for instance, it is also desired to exchange the lower roller, then the intermediate elements 28, 29 and the stops or impact members 27 which are detachably connected to the reinforcement ribs 26 or equivalent structure of the guides 7 are to be removed. As apparent from the showing of FIG. 4, the stops or impact members 27 can be easily withdrawn out of the pockets of the reinforcement ribs 26 at good accessible locations following removal of a wedge or key connection. The lower transverse support 14 can be lifted-out at the hooks 22 with the aid of a suitable lifting mechanism or tool. The pressure cylinder means 17 remain however in the machine frame 5. If desired, however, it is also possible to simultaneously raise in one stroke the entire module, i.e. the upper and the lower transverse supports 11, 14 together with both of the pressure cylinder means 17 can be lifted-out, whereby, initially the intermediate elements 28, 29 and the stops 27 as well as the hydraulic connections to the pressure cylinder means 17 are removed.

Figure 3:
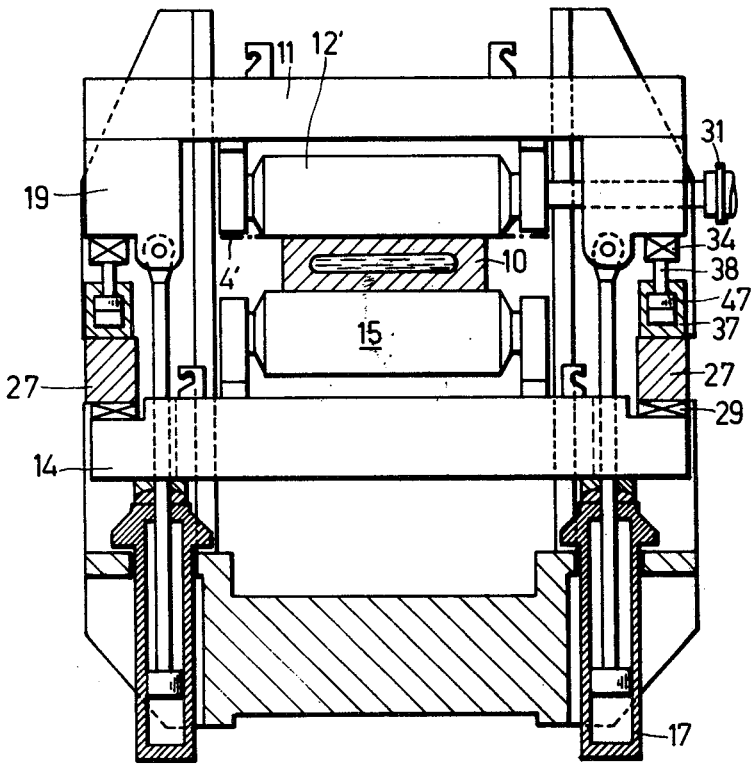
FIG. 3 is a cross-sectional view, taken substantially along the line III—III of FIG. 1, through the withdrawal and straightening machine thereof.

In FIG. 3 there is illustrated a module of the support roller apron which is equipped with a driven upper roller 12'. The construction of this module is essentially the same as the module illustrated in FIG. 2 having the non-driven rollers. Hence, as a matter of convenience there have been utilized in the showing of FIG. 3, for the same or analogous components, the same reference characters as have been employed for the arrangement of FIG. 2. In contrast to the non-driven rollers 12 of FIG. 2 the upper driven roller 12' is forced by means of the pressure cylinder means 17 against an additional pressure cylinder means 37. This pressure cylinder means 37 is arranged between the stop or impact member 27 and the bracket 19 of the transverse support 11 and renders it possible for the roller 12' together with its drive 31 to be moved through an additional contact path from the reference dimension of the upper strand path or track 4' towards the strand 10. This enables conveying a dummy bar which is thinner than the reference thickness of the cast strand.

If the upper roller 12' is located in its contact position, which corresponds to the reference thickness of the cast strand, as illustrated in FIG. 3, then the piston 38 impacts against its displacement path-limiting means 47 located in the cylinder 37 and does not transmit any force to the upper transverse support 11. This transverse support 11 is applied in this position through the force of the pressure cylinder means 17 to the strand 10. The force of the pressure cylinder means 17 is therefore at least so great that there can be supported the ferrostatic pressure of the liquid core in the strand 10. If desired, the force of the pressure cylinder means 17 also can be selected such that it is possible to exert a rolling-off action at the strand within certain limits. If the roller 12' is forced outwardly from the reference-strand path or track 4' by the strand 10, then the transverse support 11 no longer is in contact with the piston of the pressure means 37 and there is eliminated its effect at this contact region of the roller 12'.

In order to convey a strand which is thinner than the contemplated reference dimension, a dummy bar which is thinner in relation to the reference thickness of the cast strand, it is possible, as already mentioned, to apply the roller 12' towards the strand past the reference line of the strand path or track 4'. The resultant contact force $P_R$ in this displacement region is composed of the force $P_1$ of the pressure cylinder means 17 minus the force $P_2$ of the pressure cylinder means 37. The force $P_R$ is dimensioned such that it is sufficient to convey or transport the dummy bar and the strand 10 with a number of further driven rollers. Such driven rollers 12' at the region of the reference line of the strand path or track 4' in the direction of the strand, as a general rule, have exerted thereat an application or contact force which is smaller than that which would be necessary for supporting the ferrostatic pressure. A rolling of the cast strand 10, in this contact region, is also not possible in the presence of changing casting parameters.

In order to accommodate the system to different cross-sections or shapes of the strand there can be employed in the module of FIG. 3 intermediate elements 34 between the pressure cylinder means 37 and the transverse support 11.

Figure 5:
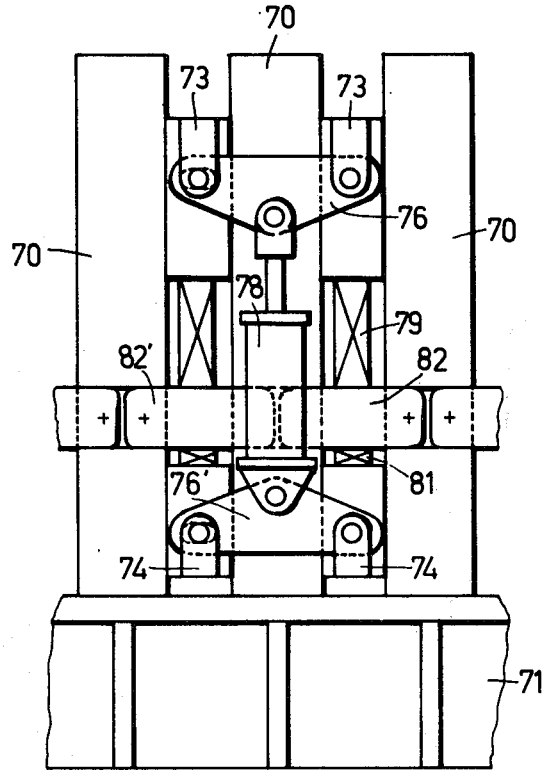
FIG. 5 is a side view of a different embodiment of a roller apron.

In FIG. 5 comb-like guides 70 are connected with a base frame 71. Upper transverse supports 73 of two rollers which follow one another in the direction of travel of the strand and two lower transverse supports 74 of corresponding rollers are connected externally of the guides 70 in each case by means of balance beam-like brackets or rocker arms 76, 76' interconnecting in each case both transverse supports 73, 74 with common pressure cylinder means 78 for these rollers. The application or contact force of the pressure cylinder means 78, like in the embodiment of FIG. 2, is applied through the agency of the intermediate elements 79, 81 and the stops or impact members 82, 82' which are detachably connected at the guides 70. A modification of the construction of FIG. 5 is possible, in that here however, for instance, also only both of the upper transverse supports 73 are connected with a pressure cylinder means articulated with the machine frame.

For the described roller apron both the driven as well as also the non-driven modules can be formed of the same basic elements, such as transverse supports 11, 14, rollers 12, 15, pressure cylinder means 17. Hence, the storage of replacement parts and servicing and maintenance is simplified.

If, for instance, there is desired a contact of the lower roller 15 in a horizontally arranged guide cross-section also with pressure-relieved pressure cylinder means 17, then the lower transverse support 14 additionally can be placed upon a package of springs. The force of this spring package then compensates at least the force of gravity of the lower transverse support 14 with its roller 15. The contact force produced by the pressure cylinder means 17 is thus distributed more uniformly to both rollers.

The described roller apron is not only usable for arc-type or curved continuous casting installations. Also in the case of installations having straight or only partially curved strand guide arrangements is it possible to utilize to advantage this roller apron at least in partial sections of a number of modules.

While there Accordingly, shown and described present preferred embodiments of the invention, it is to be distinctly understood that the invention is not limited thereto, but may be otherwise variously embodied and practiced within the scope of the following claims.

We claim:

1. A roller apron for a continuous casting installation, especially for casting steel, to support and guide a strand moving in a predetermined direction of travel, comprising:
   - a machine frame;
   - comb-like arranged guide means disposed to both sides of the machine frame;
   - pairs of successive rollers mutually displaceable independently of one another along said guide means;
   - said guide means being disposed transversely with respect to the direction of travel of the strand;
   - each of said rollers having bearings for supporting said rollers;
   - a respective transverse support at which there are mounted the bearings of each one of the two rollers of a roller pair;
   - said transverse supports cooperating with the comb-like arranged guide means;
   - pressure cylinder means for moving said transverse supports; and
   - stop means provided at the machine frame against which there can be contactingly applied at least the transverse supports of non-driven rollers.

2. The roller apron as defined in claim 1, wherein:
   - at least some of said rollers define driving rollers.

3. The roller apron as defined in claim 1, wherein:
   - at least some of said rollers define straightening rollers.

4. The roller apron as defined in claim 1, wherein:
   - said rollers define driving rollers and straightening rollers.

5. The roller apron as defined in claim 1, wherein:
   - said pressure cylinder means connect both transverse supports of a roller pair at both sides of the machine frame externally of the guide means.

6. The roller apron as defined in claim 5, wherein:
   - said pressure cylinder means are arranged at the outside of a transverse support of a lower roller which is situated opposite an attachment side of the related bearings of said lower roller.

7. The roller apron as defined in claim 1, further including:
   - balance beam-like bracket means for interconnecting the transverse supports of two rollers which follow one another in the direction of travel of the strand externally of the guide means with a common pressure cylinder means for both of such rollers.

8. The roller apron as defined in claim 1, further including:
   - an additional pressure cylinder means arranged between the stop means and one of said transverse supports carrying a driven roller;
   - said additional pressure cylinder means including a piston and displacement path-limiting means for said piston.

9. A roller apron for a continuous casting installation, especially for casting steel, to support and guide a strand moving in a predetermined direction of travel, comprising:
   - a machine frame;
   - guide means disposed to both sides of the machine frame;
   - pairs of successive rollers mutually displaceable independently of one another along said guide means;

said guide means being disposed transversely with respect to the direction of travel of the strand;

each of said rollers having bearings for supporting said rollers;

a respective transverse support at which there are mounted the bearings of each related one of the two rollers of a roller pair;

said transverse supports cooperating with the guide means;

pressure cylinder means for moving said transverse supports; and means provided at the machine frame against which there can be applied at least the transverse supports carrying rollers which are non-driven.

* * * * *